US006338481B1

(12) United States Patent
Maruchi

(10) Patent No.: US 6,338,481 B1
(45) Date of Patent: Jan. 15, 2002

(54) SHEET DECURLING APPARATUS

(75) Inventor: Noritoshi Maruchi, Toyokawa (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/525,754

(22) Filed: Mar. 14, 2000

(30) Foreign Application Priority Data

Mar. 24, 1999 (JP) ..... 11-080346

(51) Int. Cl.[7] ..... B65H 29/70
(52) U.S. Cl. ..... 271/188; 271/242; 271/209
(58) Field of Search ..... 271/242, 209, 271/184, 185, 188

(56) References Cited

U.S. PATENT DOCUMENTS

| | | | | |
|---|---|---|---|---|
| 4,975,716 A | * | 12/1990 | Hara et al. | 271/242 X |
| 5,300,012 A | | 4/1994 | Kamada | |
| 5,775,690 A | * | 7/1998 | Quesnel et al. | 271/242 |
| 5,904,350 A | * | 5/1999 | Creighton et al. | 271/242 X |
| 5,933,697 A | * | 8/1999 | Onodera et al. | 271/242 X |
| 6,092,803 A | * | 7/2000 | Munenaka | 271/242 |

FOREIGN PATENT DOCUMENTS

| | | | |
|---|---|---|---|
| JP | 1-167164 | | 6/1989 |
| JP | 01167164 | * | 6/1989 |
| JP | 4-173655 | | 6/1992 |

* cited by examiner

*Primary Examiner*—Christopher P. Ellis
*Assistant Examiner*—Patrick Mackey
(74) *Attorney, Agent, or Firm*—McDermott, Will & Emery

(57) ABSTRACT

The rotation of the second conveyance rollers located downstream from the first conveyance rollers, which are located downstream from the thermal fixing device of the image forming apparatus, is stopped for a prescribed period of time, or the speed of the second conveyance rollers is made slower than that of the first conveyance rollers. A loop is formed in the sheet through this difference in rotation speed, and the curling of the sheet caused through the thermal fixing is corrected. A torque limiter (or one-way clutch) is mounted at least in the drive path for either the first or second conveyance path. When a rigid sheet such as thick paper or low-moisture paper—for which curling is not likely—is conveyed, slipping occurs in the drive path due to the rigidity of the sheet itself, and the loop formation is automatically cancelled. When a high-moisture thin sheet, in which curling is likely, is conveyed, no slipping occurs in the drive path and a loop in the opposite direction from the curling is formed, whereby the curling is reliably corrected.

13 Claims, 7 Drawing Sheets

| moisuture content / basic weight | 2% | 4% | 6% | 8% |
|---|---|---|---|---|
| 50g/m$^2$ | 3 | 4 | 5 | 5 |
| 64g/m$^2$ | 1 | 2 | 3 | 4 |
| 80g/m$^2$ | 0 | 1 | 2 | 3 |
| 104g/m$^2$ | 0 | 0 | 0 | 1 |
| 124g/m$^2$ | 0 | 0 | 0 | 0 |

FIG. 8

SHEET DECURLING APPARATUS

RELATED APPLICATIONS

The present application claims priority to Japanese Patent Application No.11-80346 filed Mar. 24, 1999, the content of which is hereby incorporated by reference.

BACKGROUND OF THE INVENTION

1. Field of the Invention

The present invention pertains to a sheet decurling apparatus, and more particularly to a sheet decurling apparatus that corrects the curling of sheets of paper caused by the thermal fixing of the toner image onto the sheet in image forming apparatuses such as copying machines, printers and facsimile machines.

2. Description of the Related Art

The conventionally known sheet decurling apparatus of this type has a decurling conveyance path in which decurling takes place and a non-decurling conveyance path in which decurling does not take place, such that curled sheets are automatically guided to the decurling conveyance path based on the amount of curling in the front end of the sheet, and sheets that are not curled are guided to the non-decurling conveyance path by a fixed conveyance path alternating device, as disclosed in U.S. Pat. No. 5,300,012.

Other technologies have also been proposed in which the amount and direction of curling in the sheet is detected by a sensor and an appropriate conveyance path is selected accordingly, or in which the device is equipped with a decurling mechanism that allows the degree of decurling to be adjusted.

As a method to decurl, as disclosed in Japanese Laid-Open Patent Application Hei 4-173655, a technology has been proposed to decurl by forming a loop in the sheet in the opposite direction from the curling based on a difference in speed between the rollers.

However, in the method disclosed in U.S. Pat. No. 5,300,012, because the selection of a conveyance path depends on the amount of curling in the front end of the sheet, a non-curled sheet may be sent to the correction path by mistake, depending on the conveyance situation. In such a case, a sheet that does not require curling is curled unnecessarily.

In contrast, the technology disclosed in Japanese Laid-Open Patent Application provides an appropriate correction effect based on the detection of the amount of curling. However, because the amount of curling in the front end of the sheet is detected by multiple transmission sensors, erroneous detection is quite likely due to the behavior of the sheet during conveyance, and therefore the technology is impractical. Furthermore, the technology has the reverse effect that, because the decurling device is set to appropriately correct the curling of thin sheets, which are the main type of paper used, when a thick sheet of paper is conveyed, substantial curling occurs in the opposite direction from normal curling.

SUMMARY OF THE INVENTION

The object of the present invention is to provide an image forming apparatus that can appropriately decurl in thin sheets of paper and does not cause curling in thick sheets of paper in the opposite direction from normal curling.

Another object of the present invention is to provide a sheet decurling apparatus having a simple construction that automatically cancels the decurling operation for sheets in which curling is not likely, such as thick sheets, and that reliably corrects thin paper with high moisture content, where large curling tends to occur.

These and other objects are attained by a sheet decurling apparatus comprising a first conveyance device that conveys the sheet; a second conveyance device that is located downstream from the first conveyance device and that coveys the sheet further downstream; a drive source to drive the first and second conveyance device; a control device that controls the speed of the first and second conveyance device to form a loop in the sheet between the first and second conveyance device; and a space that is located between the first and second conveyance device and that receives the loop in the sheet, wherein when the sheet's rigidity exceeds a prescribed level, slipping occurs between the drive source and the sheet.

In the construction described above, where curling is not likely, such as with rigid sheets such as thick paper or paper with low moisture content, slipping occurs in the drive path due to the rigidity of the sheet itself. Therefore, loop formation is automatically cancelled, and consequently no unnecessary curling occurs. Thin paper with a high moisture content that is highly subject to curling is not rigid, and therefore no slipping occurs in the drive path, such that a loop is formed in the opposite direction from the curling, leading to reliable correction of the curling. In order to form a loop in a sheet, any method may be used, including a method in which the conveyance by the downstream second conveyance device is stopped for a prescribed period of time.

If control is performed such that the second conveyance device conveys the sheet at a slower speed than the first conveyance device, the loop moves from the front end to the trailing edge of the sheet being conveyed, and therefore a decurling effect may be obtained for the entire sheet. If the difference in conveyance speed between the first conveyance device and the second conveyance device is maintained, the loop continues to grow, which increases the decurling effect on the trailing edge of the sheet.

In addition, it is preferred that a drive force limiting device be used that can employ a different torque depending on the direction of conveyance, such as a torque limiter or one-way clutch, so that slipping will occur between the drive source and the sheet when the sheet's rigidity exceeds a prescribed level. If a drive force limiting device is used, a difference in conveyance drive force may be reliably generated so that a loop having an appropriate size may be automatically formed in accordance with the rigidity of the sheet.

Where a drive force limiting device having a lower torque for the direction of conveyance than for the opposite direction is mounted to the first conveyance device, if a rigid sheet is used that does not need much decurling, such as thick paper, the drive force limiting device for the first conveyance device spins idly and the drive is not transmitted. This situation creates the same effect as the slipping of the sheet, making conveyance impossible, and as a result no unnecessary loop is formed.

Where a drive force limiting device having a higher torque for the direction of conveyance than for the opposite direction is mounted to the second conveyance device, when the sheet is conveyed by the drive force of the second conveyance device, the sheet moves faster than the drive speed, resulting in cancellation of the loop.

If the sheet decurling apparatus is located downstream from the fixing device of the image forming apparatus, decurling may be effectively performed to the sheet that has just undergone fixing and been curled. If the fixing device of the image forming apparatus is used as the first conveyance device, no special conveyance device need be added, and an increase in cost may thereby be avoided.

Where the fixing device comprises a pair of heat rollers, the space to receive the loop of the sheet is created on the side of the roller having the lower temperature, relative to the sheet conveyance path. In this construction, while the curling that occurs in the sheet through the thermal fixing process is generally oriented toward the side of the element of the thermal fixing device having the higher temperature, a loop is formed in the opposite direction from the curling, whereby decurling may be effective performed.

The first conveyance device may be located inside the finisher connected to the image forming apparatus. Alternatively, the first conveyance device may be located on the side of the image forming apparatus, while the second conveyance device may be located on the side of the sheet processing device connected to the image forming apparatus. In this construction, because a connecting area between the two devices is used, a compact apparatus having a decurling effect on curling may be obtained.

The invention itself, together with further objects and attendant advantages, will best be understood by reference to the following detailed description taken in conjunction with the accompanying drawings.

BRIEF DESCRIPTION OF THE DRAWINGS

FIG. 8 shows the relationship among the thickness of the sheet, the moisture content, and the loop configuration.

In the following description, like parts designated by like reference numbers throughout the several drawings.

DETAILED DESCRIPTION OF THE PREFERRED EMBODIMENTS

Figure 1:
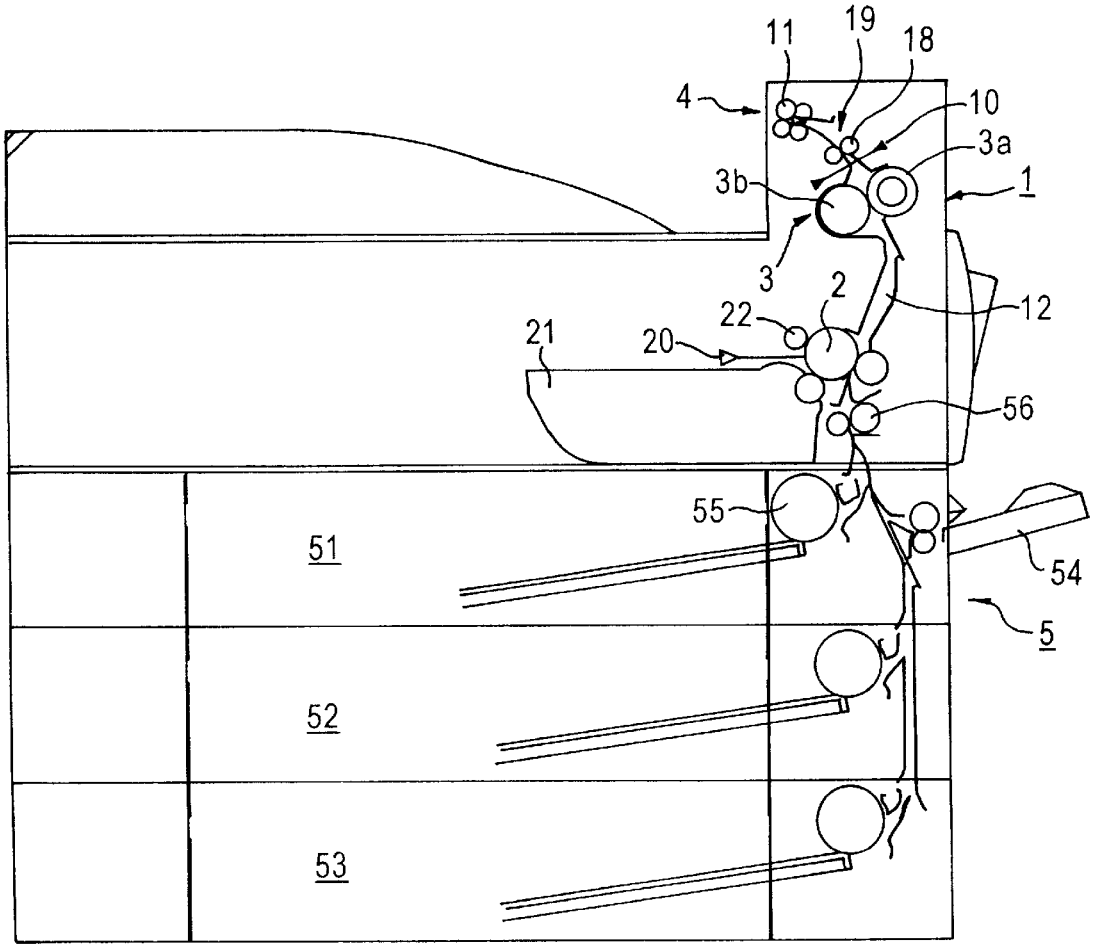
FIG. 1 shows the construction of an image forming apparatus equipped with the sheet decurling apparatus comprising an embodiment of the present invention.

The embodiments of the present invention are explained below with reference to the drawings. The sheet decurling apparatus in these embodiments is mounted in an electrophotographic device (image forming apparatus) such as a laser printer or copying machine. FIG. 1 shows an image forming apparatus equipped with the sheet decurling apparatus of one embodiment. The image forming apparatus 1 transfers the toner image formed on the photoreceptor 2 onto a sheet being conveyed, thermally fixes the transferred image by the thermal fixing device 3, and ejects the sheet on which an image has been formed onto the paper eject unit 4. Various electrophotographic processing devices including an exposure device 20, developing device 21 and transfer 22 are located around the photoreceptor 2. The paper supply device 5 has multiple paper supply cassettes 51, 52 and 53 and a manual paper supply unit 54. The sheets are supplied from one of the cassettes of the paper supply device 5 one by one by the paper supply roller 55 and are supplied through sheet conveyance path 12 in which the conveyance rollers 56 are located. The thermal fixing device 3 comprises a heat roller 3*a* and a pressure roller 3*b*.

In the sheet conveyance path 12 below the thermal fixing device 3 toward the paper eject unit 4 are located a sheet sensor 10 that detects sheets, a pair of first conveyance rollers 18 (the first conveyance device), a pair of second conveyance rollers 11 (the second conveyance device: these also comprise the paper eject rollers in this embodiment), which is located downstream from the first conveyance rollers, and a space 19 between the first conveyance rollers 18 and the second conveyance rollers 11 that receives the warp (loop) in the sheet. A loop may be formed in the sheet by controlling the conveyance by the first conveyance rollers 18 and the second conveyance rollers 11. These components comprise a sheet decurling apparatus that corrects the curling that has occurred in the sheet due to the thermal fixing process.

Figure 2:
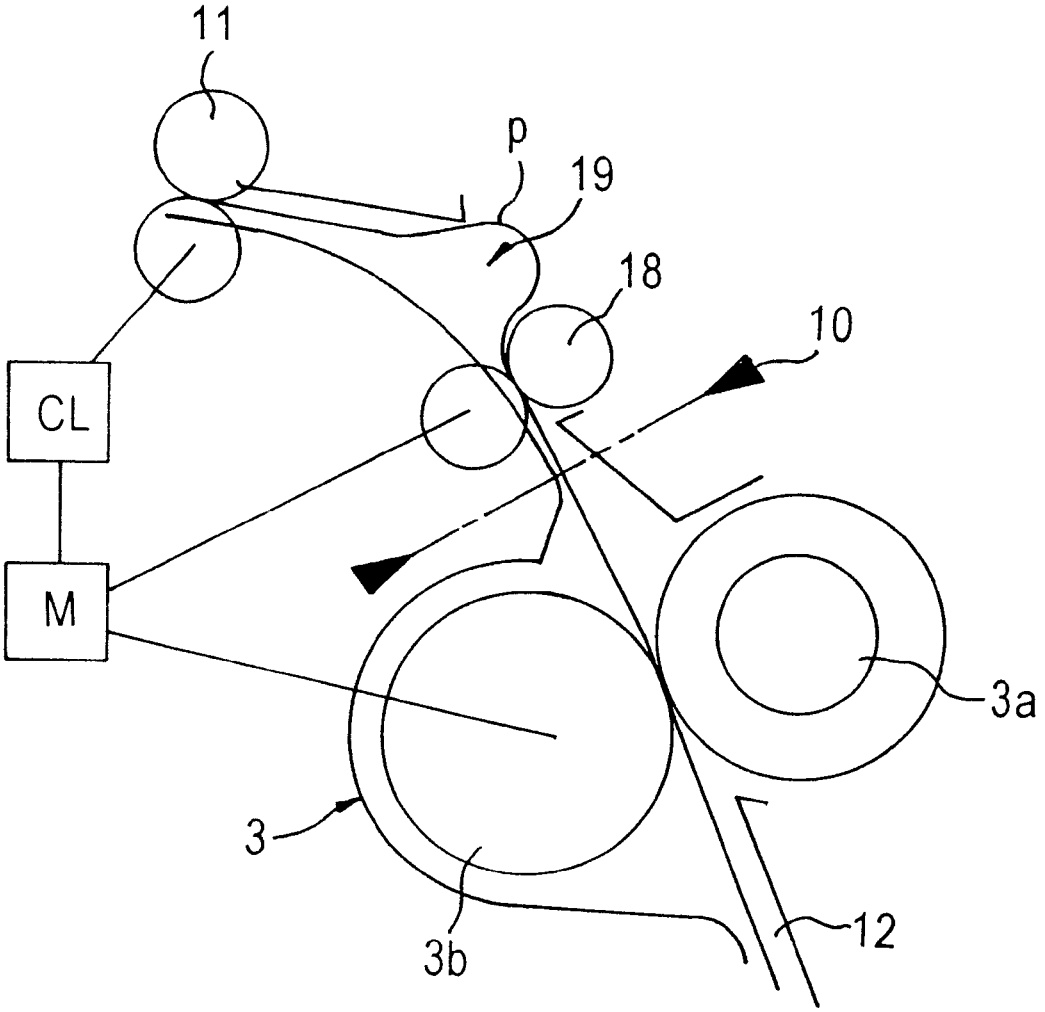
FIG. 2 shows the construction of a basic form of the sheet decurling apparatus.
Figure 3:
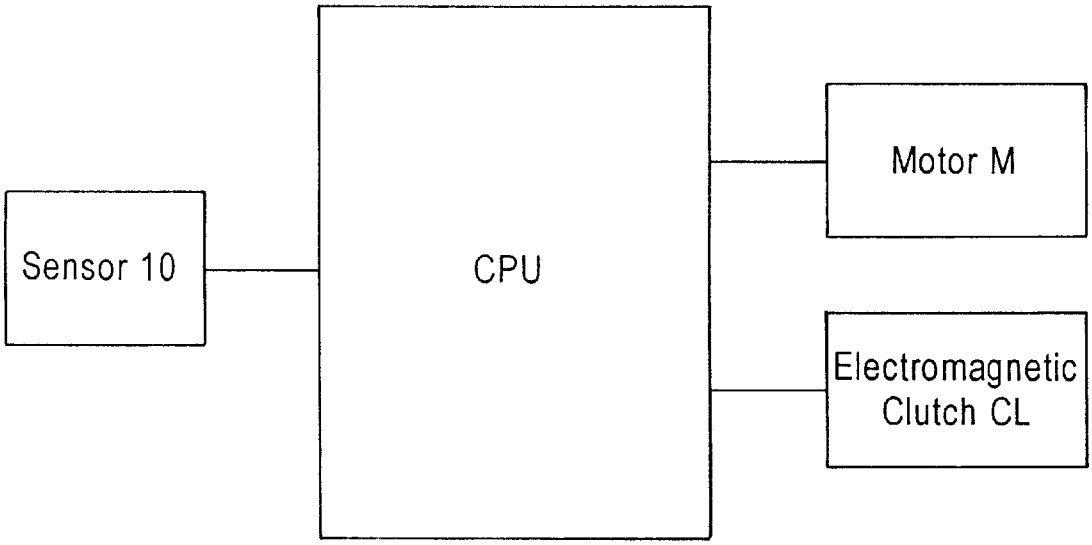
FIG. 3 is a block diagram of the control circuit of the sheet decurling apparatus.

FIG. 2 shows the construction of the basic form of the sheet decurling apparatus. The toner image is thermally fixed onto the sheet P by the thermal fixing device 3. The sheet P then passes through the sheet detection sensor 10, which is located downstream from the thermal fixing device 3, and is conveyed to the fist conveyance rollers 18. The first conveyance rollers are driven by a motor M. The second conveyance rollers are connected to the motor M via an electromagnetic clutch CL, such that it can rotate and stop rotation the sheet detection sensor 10, the motor 10 and the electromagnetic clutch is controlled by a CPU shown in FIG. 3. The electromagnetic clutch CL is disengaged based on a signal that indicates that the sheet detection sensor 10 has detected the front end of the sheet to stop the rotation of the second conveyance rollers 11 so that a loop will be formed in the sheet. After a prescribed period has passed, the electromagnetic clutch CL is engaged, whereupon the second conveyance rollers 11 start rotating again. The conveyance speed of the second conveyance rollers 11 is set to be slightly slower than that of the first conveyance rollers 18. By changing the length of time during which the rotation of the second conveyance rollers 11 is stopped, the amount of loop in the front end of the sheet may be adjusted.

The loop formed in the sheet P is received in the space 19. Sheets in which curling occurs through the fixing process generally have high moisture content, and curl in the opposite direction from the image surface (the side of the lower-temperature roller). Therefore, the space 19 is created in the guide plate of the sheet conveyance path 12 so that a loop will be formed opposite from the direction of curling. However, in the case of a color image forming apparatus, or where the apparatus does not use the fixing method in which heat is applied from one side only, it is possible that the space should be formed on the opposite side.

The sheet P is conveyed with a loop formed as described above, such that the position of the loop in the sheet moves. The conveyance speed of the second conveyance rollers 11 is slightly slower than that of the first conveyance rollers 18, and due to this difference in speed, the amount of loop gradually increases as the sheet P continues to be conveyed. Through this operation, decurling may be performed to the sheet, regarding which curling has just occurred due to the fixing process, throughout the sheet. At the same time, the decurling effect may increase toward the trailing edge of the sheet. At least one the first pair of conveyance rollers 18 or the pair of second conveyance rollers 11 should be adjustable so that the speed of one pair of rollers may be changed relative to that of the other pair. The decurling effect may be adjusted by setting the speeds of the two pairs of conveyance rollers to be different. Such setting should be made by an input device such as an operation panel.

Figure 4:
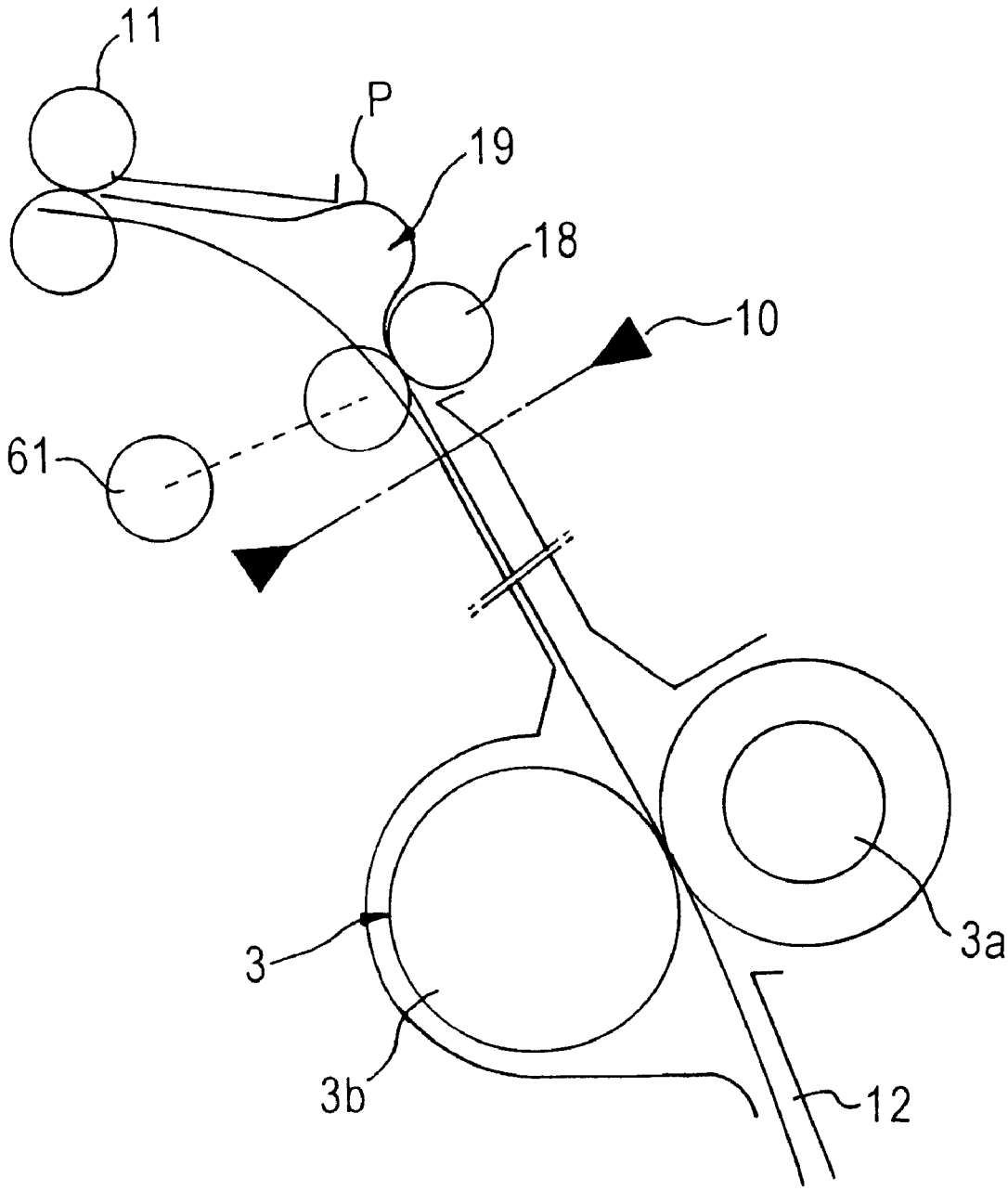
FIG. 4 shows the construction of one embodiment of the curling device.

FIG. 4 shows the construction of one embodiment of the sheet decurling apparatus. This sheet decurling apparatus comprises the construction shown in FIG. 2 plus a torque limiter 61 (drive force limiting device) that lowers the conveyance force, said torque limiter being located in the drive system that drives the first conveyance rollers 18. The drive force limiting device here is a device that creates different transmission torque depending on the direction of rotation. If such a device is mounted to the first conveyance rollers, a device that creates a lower torque for the sheet conveyance direction than for the opposite direction is used.

Using this construction, a loop of an appropriate size is automatically formed in the sheet in accordance with the rigidity of the sheet itself. In other words, in the case of rigid sheets such as thick paper or low-moisture paper which do not curl easily and therefore do not need decurling, the torque limiter 61 for the first conveyance rollers 18 spins idly, and the drive is not transmitted due to the rigidity of the sheet itself. Consequently, slipping occurs in the drive path, which leads to automatic cancellation of the loop. Therefore, no unnecessary curling occurs. On the other hand, in the case of thin paper having a high moisture content, because the rigidity of the sheet is low, no slipping occurs in the drive path. Consequently, a loop is formed in the direction opposite from the curling, reliably correcting the curling.

Figure 5:
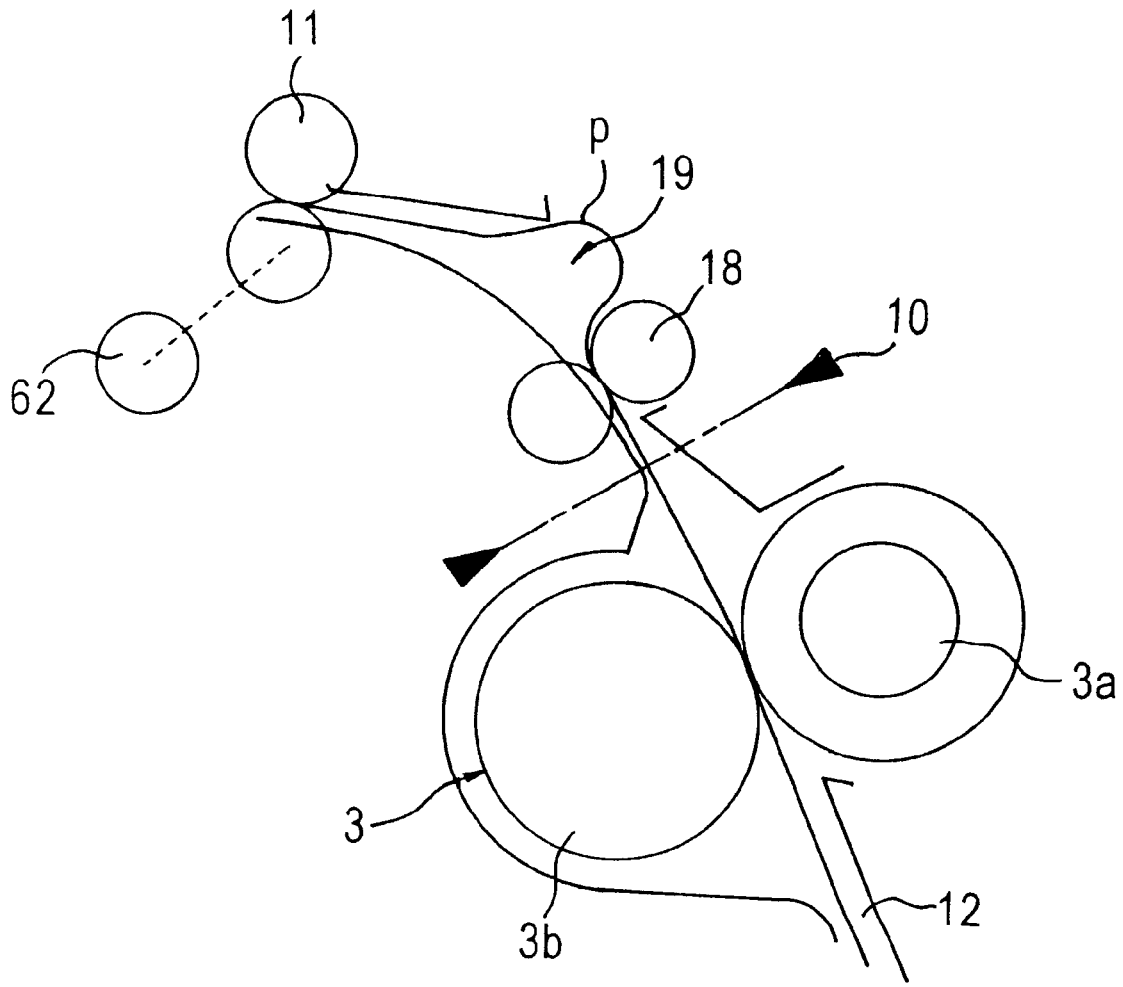
FIG. 5 shows the construction of another embodiment of the sheet decurling apparatus.

FIG. 5 shows the construction of another embodiment of the sheet decurling apparatus. In this embodiment, the sheet decurling apparatus has a one-way clutch 62 (drive force limiting device) in the drive system that drives the second conveyance rollers 11. Where a drive force limiting device is mounted to the second conveyance rollers 11, a device that has a higher torque for the sheet conveyance direction than for the opposite direction is used. The drive force limiting device is not limited to a one-way clutch, however, and a torque limiter having an equivalent function may be used instead.

Using the construction described above, when the sheet is conveyed via the drive force of the second conveyance rollers 11, if the sheet is highly rigid, the sheet moves faster than the drive speed due to the slipping caused by the one-way clutch 62. Consequently, a loop in a rigid sheet may be reliably cancelled.

Figure 6:
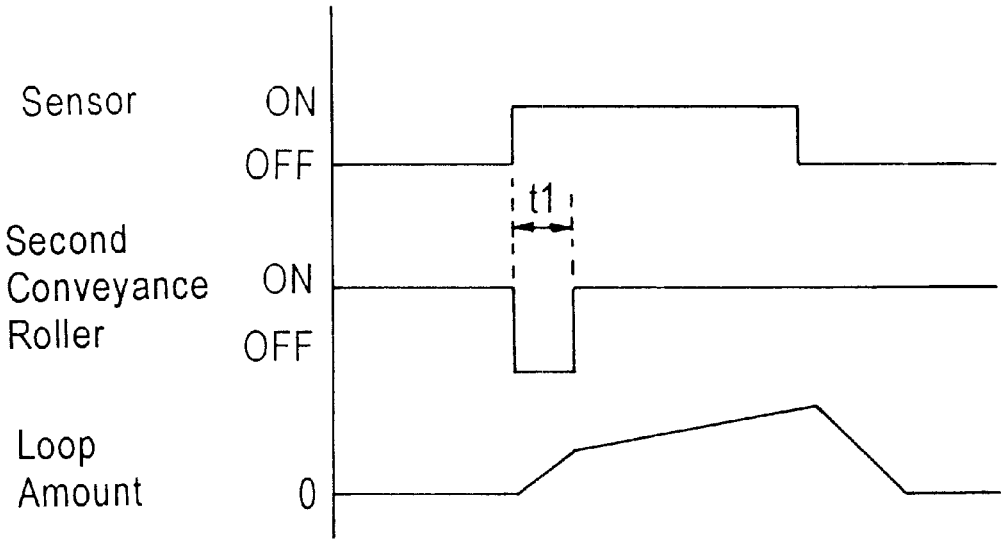
FIG. 6 is a time chart of the loop amount control operation in the sheet decurling apparatus.

The loop amount control operation in the sheet decurling apparatus described above will now be explained with reference to the time chart of FIG. 6. When the sheet detection sensor 10 detects the front end of the sheet and its signal is turned ON, the electromagnetic clutch LL is disengaged so that the second conveyance rollers stop rotating. After a prescribed period of time t1 has elapsed, the electromagnetic clutch CL is engaged in order to re-start the rotation of the second conveyance rollers 11. Because the conveyance speed of the first conveyance rollers 18 is faster than that of the second conveyance rollers 11, the position of the loop formed in the sheet between the two pairs of rollers moves while gradually becoming larger. Furthermore, when the trailing edge of the sheet leaves the first conveyance rollers 18 after the sheet detection sensor 10 detects the trailing edge of the sheet and its signal is turned OFF, the loop gradually disappears.

Figure 7:
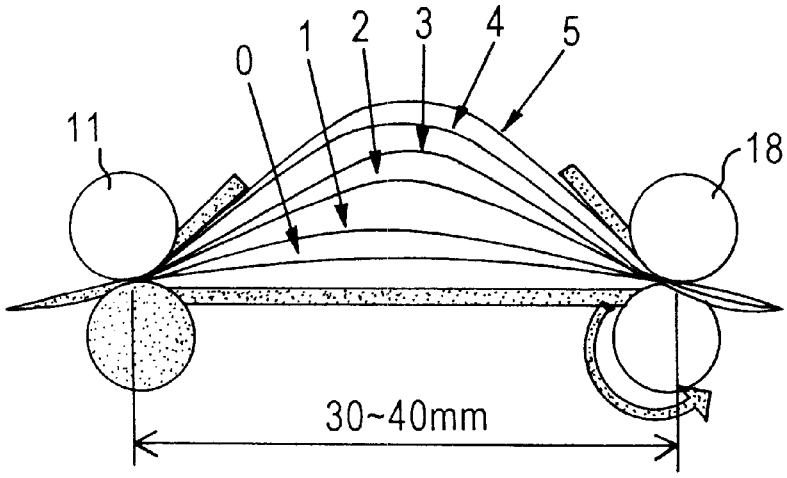
FIG. 7 shows the operation of the sheet decurling apparatus.

The loop formation during sheet conveyance using the method of the present invention involving a drive force limiting device as described above will now be explained. FIG. 7 shows configurations of the curling formed depending on the type of sheet, using the construction shown in FIG. 5 in which a one-way clutch 62 is mounted to the drive device for the second conveyance rollers 11. FIG. 8 shows the relationships among the thickness of the sheet (basic weight), moisture content and loop configuration (the distance between the two pairs of rollers is 30 to 40 millimeters). The number assigned to each curling configuration in FIG. 7 corresponds to the numbers in the cells of FIG. 8. By adjusting the distance between the two pairs of rollers and the slipping torque of the one-way clutch, a desired loop configuration may be easily obtained. Consequently, the effect of decurling may be adjusted.

Ordinarily, the thinner the sheet, the more it is subject to the influence of its moisture content (or the humidity). Therefore, the thinner the sheet and the higher its moisture content, the larger its curling becomes. Using the method of the present invention, the more susceptible to curling the sheet is, the larger the loop configuration and the larger the effect of decurling becomes. Moreover, curling may be effectively corrected using a simple component such as a one-way clutch without using a complex control mechanism.

The present invention is not limited to the construction of the embodiments explained above, and may be modified or applied in various ways. For example, the method of the present invention may be similarly employed in a paper eject device (sheet processing device) such as a sorter that receives sheets on which images have been formed and that have been output from an image forming apparatus. In this case, the paper eject device should be equipped with conveyance rollers (the second conveyance device) that receive the sheets ejected by the paper eject rollers of the image forming apparatus (the first conveyance device), and control should be performed so that the downstream conveyance rollers will be driven at a slower rate of rotation than the paper eject rollers, so that the conveyance of the front end of the sheet will slow down and form a loop will be formed in the sheet in the space formed between the image forming apparatus and the paper eject device. The same drive force limiting device may be used in the same way as in the constructions explained above. It is also acceptable to locate the first conveyance rollers in the paper eject device instead of using the paper eject rollers of the image forming apparatus as the first conveyance rollers.

In addition, referring to FIG. 2, there need not be a separate pair of first conveyance rollers 18, as the heat roller 3*b* of the thermal fixing device 3 can serve as the first conveyance device.

Although the present invention has been fully described by way of examples with reference to the accompanying drawings, it is to be noted that various changes and modifications will be apparent to those skilled in the art. Therefore, unless such changes and modification depart from the scope of the present invention, they should be constructed as being included therein.

What is claimed is:

1. A sheet decurling apparatus, comprising:

a first conveyance device that conveys the sheet;

a second conveyance device that is located downstream from said first conveyance device and that coveys the sheet further downstream;

a drive source to drive said first and second conveyance device;

a control device that controls the speed of said first and second conveyance device to form a loop in the sheet between said first and second conveyance device; and a space that is located between said first and second conveyance device and that receives the loop in the sheet, wherein when the rigidity of the sheet exceeds a prescribed level, slipping occurs between said drive source and the sheet.

2. A sheet decurling apparatus according to claim 1, wherein said control device stops said second conveyance device while said first conveyance device is driven.

3. A sheet decurling apparatus according to claim 1, wherein said control device drives said second conveyance device at a slower speed than said first conveyance device while said first conveyance device is driven.

4. A sheet decurling apparatus according to claim 1, further comprising a drive force limiting device that is arranged between said first conveyance device and said drive source and that has a lower torque for the direction of sheet conveyance than for the opposite direction.

5. A sheet decurling apparatus according to claim 1, further comprising:

a drive force limiting device that is arranged between said second conveyance device and said drive source and that has a higher torque for the direction of sheet conveyance than for the opposite direction.

6. An image forming apparatus, comprising:

an image forming device that forms an image on a sheet;

a first conveyance device that conveys the sheet;

a second conveyance device that is located downstream from said first conveyance device and that coveys the sheet further downstream;

a drive source to drive said first and second conveyance device;

a control device that controls the speed of said first and second conveyance device to form a loop in the sheet between said first and second conveyance device; and a space that is located between said first and second conveyance device and that receives the loop in the sheet, wherein when the rigidity of the sheet exceeds a prescribed level, slipping occurs between said drive source and the sheet.

7. An image forming apparatus according to claim 6, wherein said control device stops said second conveyance device while said first conveyance device is driven.

8. An image forming apparatus according to claim 6, wherein said control device drives said second conveyance device at a slower speed than said first conveyance device while said first conveyance device is driven.

9. An image forming apparatus according to claim 6, further comprising a drive force limiting device that is arranged between said first conveyance device and said drive source and that has a lower torque for the direction of sheet conveyance than for the opposite direction.

10. An image forming apparatus according to claim 6, further comprising a drive force limiting device that is arranged between said second conveyance device and said drive source and that has a higher torque for the direction of sheet conveyance than for the opposite direction.

11. An image forming apparatus according to claim 6, further comprising a fixing device that thermally fixes the image on the sheet.

12. An image forming apparatus according to claim 11, wherein said first conveyance device is located downstream from said fixing device.

13. An image forming apparatus according to claim 6, wherein said first conveyance device thermally fixes the image on the sheet.

* * * * *